US005773153A

United States Patent [19]

Shiokawa et al.

[11] Patent Number: 5,773,153

[45] Date of Patent: Jun. 30, 1998

[54] THERMAL IMAGE TRANSFER RECORDING MEDIUM

[75] Inventors: Keiichi Shiokawa, Shizuoka-ken; Hiroshi Tohmatsu, Numazu; Yoji Ide, Mishima; Yoichi Iwaki, Nisshin; Shigekazu Teranishi, Nagoya; Susumu Kawakami, Nisshin; Hironori Hata, Aichi-ken, all of Japan

[73] Assignee: Ricoh Company, Ltd., Tokyo, Japan

[21] Appl. No.: 525,139

[22] Filed: Sep. 8, 1995

[30] Foreign Application Priority Data

Sep. 9, 1994 [JP] Japan ..... 6-242345
Oct. 26, 1994 [JP] Japan ..... 6-262176

[51] Int. Cl.[6] ..... B41M 5/26

[52] U.S. Cl. ..... 428/447; 428/195; 428/488.5; 428/500; 428/913; 428/914

[58] Field of Search ..... 428/195, 488.4, 428/447, 500, 413, 407, 484, 488.1, 913, 914

[56] References Cited

U.S. PATENT DOCUMENTS 4,529,993 7/1985 Watanabe et al. .
4,627,997 12/1986 Ide .
4,983,444 1/1991 Ide et al. .
5,053,267 10/1991 Ide et al. .
5,087,527 2/1992 Shimura et al. .
5,110,389 5/1992 Hiyoshi et al. .
5,134,019 7/1992 Shiokawa et al. .
5,179,388 1/1993 Shiokawa et al. .
5,183,697 2/1993 Ide et al. .
5,229,189 7/1993 Hiyoshi et al. .
5,238,726 8/1993 Ide et al. .
5,250,361 10/1993 Ide et al. .
5,258,234 11/1993 Ide et al. .
5,324,585 6/1994 Akiyama et al. .
5,328,747 7/1994 Ide et al. .
5,336,548 8/1994 Shiokawa et al. .
5,362,548 11/1994 Hiyoshi et al. .
5,409,758 4/1995 Hiyoshi et al. .
5,428,372 6/1995 Akiyama et al. .

*Primary Examiner*—Pamela R. Schwartz
*Attorney, Agent, or Firm*—Oblon, Spivak, McClelland, Maier & Neustadt, P.C.

[57] ABSTRACT

A thermal image transfer recording medium includes a substrate, a thermal image transfer ink layer provided on the substrate, and a heat resistant protective layer which is provided on the back side of the substrate, opposite to the thermal transfer ink layer with respect to the substrate, with which a thermal head comes into contact. The heat resistant protective layer is made of an organic polymeric material free from cross-linking structure, with a film strength of 10 mN or more, and the surface of the heat resistant protective layer has a contact angle with pure water of 95° or more and a dynamic coefficient of friction of 0.07 or less. The heat resistant protective layer may also be made of a modified copolymer containing (a) a main backbone chain polymer including an active-hydrogen-containing polymer which encompasses no cellulose compounds and (b) a side chain polymer which is a copolymer of a reactive silicone and a vinyl monomer.

10 Claims, 1 Drawing Sheet

THERMAL IMAGE TRANSFER RECORDING MEDIUM

BACKGROUND OF THE INVENTION

1. Field of the Invention

The present invention relates to a thermal image transfer recording medium which is particularly suitable for a thermal image transfer recording method by use of a thermal head.

2. Discussion of Background

In a conventional thermal image transfer recording method, image transfer is performed by the steps of bringing an image receiving sheet into pressure contact with a thermal image transfer recording medium which comprises a substrate and a thermal transfer ink layer formed thereon in such a manner that the image transfer sheet comes into contact with the thermal transfer ink layer; applying pulse-like signal voltages corresponding to the images to be recorded to a thermal head which is set in contact with the back side of the substrate, opposite to the thermal transfer ink layer with respect to the substrate, whereby heat is generated in the thermal head in accordance with the signal voltages applied thereto; and fusing or subliming the thermal transfer ink layer imagewise by the heat generated in the thermal head, so that images are transferred to the image receiving sheet and image recording is performed.

As the substrate for use in the conventional thermal image transfer recording media for the above-mentioned thermal image transfer recording method, plastics films such as a polyethylene terephthalate film are in general use.

When a thermal image transfer recording medium with a substrate made of such a plastics film is actually used in thermal image printing, the plastics film is easily fused and adheres to a thermal head during image printing operation, so that occasionally the running or transportation of the thermal image transfer recording medium is stopped or the thermal image transfer recording medium is broken by the sticking of the transfer recording to the thermal head. Such a trouble is referred to a sticking phenomenon.

In order to prevent the occurrence of such a sticking phenomenon, there have been proposed varieties of heat resistant protective layers to be provided on the back side of the substrate of such a thermal image transfer recording medium, with which side a thermal head comes into contact.

For example, heat resistant protective layers, made of silicone resin, epoxy resin, melamine resin, phenolic resin, fluoroplastics, or aromatic polyamide, have been proposed in Japanese Laid-Open Patent Applications 55-7467, 60-201989 and 63-172688. These heat resistant protective layers are made of any of the above-mentioned resins, and therefore have the shortcoming that the lubricating properties thereof are insufficient to completely prevent the occurrence of the sticking phenomenon.

In Japanese Laid-Open Patent Application 61-143195, there is proposed the use of a silicone graft or block acrylic copolymer in a heat resistant protective layer. By use of the copolymer, the sticking phenomenon can be prevented, but the film formation properties of the copolymer are so poor that it could occur that the heat resistant protective layer peels away from the substrate. Furthermore, the heat resistant protective layer is easily worn, so that improper running on transportation of the thermal image transfer recording medium is caused.

In Japanese Laid-Open Patent Applications 1-221281 and 1-234292, there are proposed a heat resistant protective layer made of ethyl cellulose resin with the addition of silicone oil thereto, and a heat resistant protective layer made of an acetate-group-containing cellulose ester resin with the addition of silicone oil thereto. In these heat resistant protective layers, the lubricant properties thereof can be improved by the addition of silicone oil and therefore the occurrence of the sticking phenomenon can be reduced. However, the silicone oil component is apt to be transferred to the thermal head and therefore the thermal head is easily smeared with the transferred silicone oil component, so that the printing quality is significantly lowered.

In a Japanese Laid-Open Patent Application 4-126294, there is proposed a heat resistant protective layer made of a mixture of an acryl silicone graft polymer and a reaction product of an amino-modified silicone oil and a polyfunctional isocyanate. In this heat resistant protective layer, the transfer of the silicone component to the surface of the thermal head is minimized, but the film formation performance of the heat resistant protective layer and the adhesion between the substrate and the heat resistant protective layer are insufficient, so that this heat resistant protective layer easily peels away from the substrate. Furthermore, the abrasive resistance of this heat resistant protective layer is not sufficiently improved.

In Japanese Laid-Open Patent Applications 5-58067 and 5-162472, there is proposed the use of a silicone polyvinyl butyral copolymer or a silicone-modified cellulose acetate phthalate for use in a heat resistant protective layer. A heat resistant protective layer comprising any of the above materials is improved with respect to the film formation properties, but the heat resistant thereof is insufficient for use in practice, so that a fused material detached from the protective layer adheres to the thermal head, resulting in the lowering of the printed image quality.

Furthermore, cross-linking reactions by use of isocyanate, melamine or epoxide with remaining hydroxyl groups in a resin employed in a heat resistant protective layer are conventionally often utilized in order to improve the heat resistance and film formation properties of the heat resistant protective layer. This method, however, has the shortcomings that a curing process is required after the coating of a heat resistant protective layer formation liquid on a substrate and that such a heat resistant protective layer formation liquid has the shortcoming that its pot life is short.

SUMMARY OF THE INVENTION

It is therefore an object of the present invention to provide a thermal image transfer recording medium provided with a heat resistant protective layer, which is capable of providing excellent printing quality and has excellent running or transportation performance during thermal printing operation, with excellent lubricating properties and minimized abrasion and peeling of the heat resistant protective layer, and which is also capable of preventing the protective layer from getting stuck with a thermal head during thermal printing operation, with the capability of preventing the transfer to the thermal head of a fused material detached from the protective layer and dust formed by the peeling and/or wearing of the protective layer.

This object of the present invention can be achieved by a thermal image transfer recording medium comprising a substrate, a thermal image transfer ink layer provided on the substrate, and a heat resistant protective layer which is provided on the back side of the substrate, opposite to the thermal transfer ink layer with respect to the substrate, with which a thermal head comes into contact, the heat-resistant protective layer comprising an organic polymeric material free from cross-linking structure, with a film strength of 10 mN or more, and the surface of the heat resistant protective layer having a contact angle with pure water of 95° or more and a dynamic coefficient of friction of 0.07 or less.

The object of the present invention can also be achieved by a thermal image transfer recording medium comprising a substrate, a thermal image transfer ink layer provided on the substrate, and a heat resistant protective layer which is provided on the back side of the substrate, opposite to the thermal transfer ink layer with respect to the substrate, with which a thermal head comes into contact, the heat resistant protective layer comprising a modified copolymer which comprises (a) a main backbone chain polymer comprising an active-hydrogen-containing polymer which encompasses no cellulose compounds and (b) a side chain polymer which is a copolymer of a reactive silicone and a vinyl monomer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
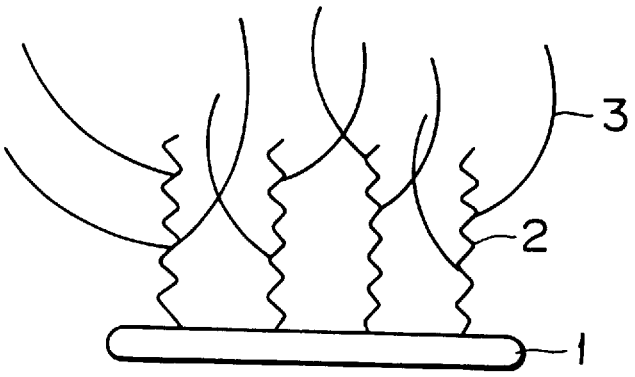
FIG. 1 is a schematic illustration of a modified polymer which is a main component of a heat resistant protective layer for a thermal image transfer recording medium of the present invention.

A thermal image transfer recording medium of the present invention comprises a substrate, a thermal image transfer ink layer provided on the substrate, and a heat resistant protective layer which is provided on the back side of the substrate, opposite to the thermal transfer ink layer with respect to the substrate, with which a thermal head comes into contact, the heat resistant protective layer comprising an organic polymeric material free from cross-linking structure, with a film strength of 10 mN or more, and the surface of the heat resistant protective layer having a contact angle with pure water of 95° or more and a dynamic coefficient of friction of 0.07 or less.

In the present invention, the film strength is determined by measuring the breaking point or abrasion initiation point of the heat resistant protective layer of the thermal image transfer recording medium under the following conditions by use of a commercially available scratch strength tester (Trademark "Rhesca CSR-02" made by Rhesca Co., Ltd.):

Stage inclination angle: 0° 30'

Stylus diameter: 100 $\mu$m

Stylus pressure: 50 gf

Amplitude: 30 $\mu$m

Further, in the present invention, the contact angle with pure water is determined by measuring the contact angle of the heat resistant protective layer of the thermal image transfer recording medium with pure water at 24°±4° C. by use of a commercially available FACE Automatic Contact Angle Meter (Trademark "CA-Z" made by Kyowa Kaimen Kagaku Co., Ltd.)

The dynamic coefficient of friction of the heat resistant protective layer is measured by use of a commercially available HEIDON surface tester made by Shinto Scientific Co., Ltd., in point contact with the heat resistant protective layer with the application of a load of 50 gf thereto by use of a 9.5 mm diameter objective quartz glass.

As mentioned above, the heat resistant protective layer for use in the present invention comprises an organic polymeric material free from cross-linking structure and has a film strength of 10 mN or more, with the surface of the heat resistant protective layer having a contact angle with pure water of 95° or more and a dynamic coefficient of friction of 0.07 or less.

By providing this heat resistant protective layer on the side of the substrate, with which heat resistant protective layer a thermal head comes into contact, the protective layer can be sufficiently prevented from getting stuck with the thermal head during thermal printing operation. Furthermore, a fused material detached from the protective layer and the dust formed by the protective layer being peeled and/or worn can be prevented from being transferred to the thermal head during thermal printing operation.

Thus, by the provision of the above-mentioned heat resistant protective layer, there can be obtained a thermal image transfer recording medium which is capable of providing excellent printing quality and has excellent running performance during thermal printing operation, with excellent lubricating properties and minimized abrasion and peeling of the heat resistant protective layer.

In particular, by setting the dynamic coefficient of friction of the surface of the heat resistant protective layer at 0.07 or less and setting the contact angle with pure water of the surface of the heat resistant protective layer at 95° or more, the sticking of the protective layer to the thermal head can be completely prevented.

By setting the film strength of the heat resistant protective layer at 10 mN or more, there can be minimized (1) the peeling of the heat resistant protective layer away from the substrate, which is otherwise caused by the friction between the heat resistant protective layer and the thermal head, and (2) the wearing of the heat resistant protective layer.

By setting the contact angle with pure water of the surface of the heat resistant protective layer at 95° or more, a fused material detached from the heat resistant protective layer can be prevented from adhering to the thermal head.

Furthermore, by setting the dynamic coefficient of friction of the surface of the heat resistant protective layer at 0.07 or less, improper running or transportation of the thermal image transfer recording medium during thermal printing operation can be prevented.

The object of the present invention can also be achieved by a thermal image transfer recording medium comprising a substrate, a thermal image transfer ink layer provided on the substrate, and a heat resistant protective layer which is provided on the back side of the substrate, opposite to the thermal transfer ink layer with respect to the substrate, with which a thermal head comes into contact, the heat resistant protective layer comprising a modified copolymer which comprises (a) a main backbone chain polymer comprising an active-hydrogen-containing polymer which encompasses no cellulose compounds and (b) a side chain polymer which is a copolymer of a reactive silicone and a vinyl monomer.

The heat resistant protective layer comprising the above-mentioned modified copolymer has excellent heat resistance, lubricating properties and adhesion to the substrate.

By the provision of the above-mentioned heat resistant protective layer on the side of the substrate with which a thermal head comes into contact, there can be obtained a thermal image transfer recording medium which is capable of providing excellent printing quality and has excellent running performance, with the prevention of the sticking of the protective layer to the thermal head, and also with the prevention of the transfer of a fused material detached from the protective layer and the dust formed by the peeling or wearing of the protective layer during thermal printing operation.

The polymer of which the main backbone chain polymer is composed for use in the present invention contains active hydrogens atoms, so that it is required that the polymer be capable of forming a radical copolymerization initiation point by hydrogen abstraction in view of the polymerization for the formation of the main backbone chain polymer.

Specific examples of such a polymer are polyethylene, ethylene-vinyl acetate copolymer, ethylene-ethyl acrylate copolymer, polypropylene, polystyrene, polyvinyl chloride resin, vinyl chloride-vinyl acetate copolymer, vinyl chloride-acrylic ester copolymer, vinyl chloride-acrylonitrile copolymer, ethylene-vinyl chloride copolymer, polyvinyl alcohol, polyvinyl formal, polyvinyl acetoacetal, polyvinyl butyral, polyvinyl nitrate, polyvinyl ether, polyamide resin, polyimide, polyamide imide, polyester resin, polycarbonate, polyacetal. These polymers may be used alone or in combination.

Of these polymers, an appropriate polymer may be selected, with the desired heat resistance, film formation properties of the heat resistant protective layer and also the desired adhesion of the heat resistant protective layer with the substrate taken into consideration.

For obtaining a heat resistant protective layer with particularly good heat resistance, polyvinyl acetoacetal and polyvinyl butyral are preferable.

Further, for obtaining a heat resistant protective layer which has particularly good film formation properties and adhesion with the substrate and which is improved with respect to the prevention of the sticking thereof to the thermal head, N-methoxymethylated nylon is preferable in various polyamide resins.

It is preferable that the amount by weight of the main backbone chain polymer in the entire weight of the modified copolymer be in the range of 1 to 80 wt. %, more preferably in the range of 5 to 60 wt. %, although the amount of the main backbone chain polymer in the modified copolymer may differ depending upon the polymerization reactivity thereof and the desired heat resistance and film formation properties of the heat resistant protective layer and the adhesion of the heat resistant protective layer with the substrate.

Examples of the reactive silicone which is employed in the preparation of the above-mentioned modified copolymer are silicone compounds having at one terminal thereof a functional group such as hydroxyl group or epoxy group; and polyalkylsiloxane compounds having at one terminal thereof a radical polymerizable unsaturated group.

It is preferable that these reactive silicones have a molecular weight in the range of about 100 to 50,000.

These reactive silicones may be used alone or in combination. In particular, it is preferable that a reactive silicone with a molecular weight of less than 500 and a reactive silicone with a molecular weight of 5000 or more in combination in order to obtain a heat resistant protective layer with an appropriate film strength which lasts for an extended period of time.

It is preferable that the amount by weight of the reactive silicone in the entire weight of the modified copolymer be in the range of 5 to 60 wt. %, more preferably in the range of 10 to 40 wt. %.

When a reactive silicone with a molecular weight of less than 500 and a reactive silicone with a molecular weight of 5000 or more are used in combination, it is preferable that the amount of the reactive silicone with a molecular weight of less than 500 be in the range of 1 to 50 wt. %, more preferably in the range of 5 to 30 wt. %; and the amount of the silicone with a molecular weight of 5000 or more be in the range of 0.5 to 30 wt. %, more preferably in the range of 1 to 20 wt. %.

Specific examples of the reactive silicone are as shown in the following TABLE 1.

Specific examples of the reactive silicone with a molecular weight of less than 500 are compounds (1) to (5), which are reactive silicone oils having at one terminal a functional group such as OH group, epoxy group, SH group, COOH group or an unsaturated double bond; and a compound (6) which is a polydimethylsiloxane polymerization initiator.

TABLE 1

(1)

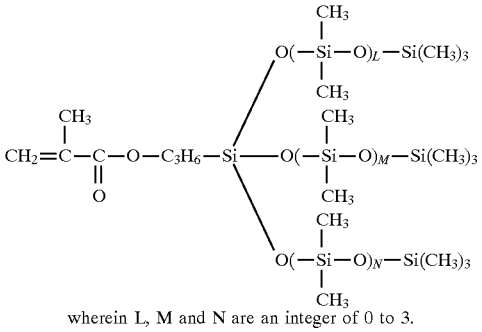

wherein L, M and N are an integer of 0 to 3.

(2)

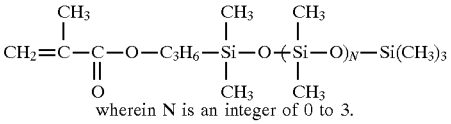

wherein N is an integer of 0 to 3.

(3)

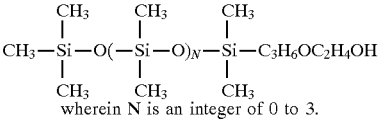

wherein N is an integer of 0 to 3.

(4)

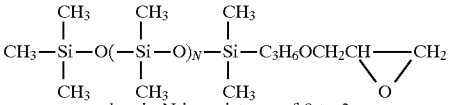

wherein N is an integer of 0 to 3.

(5)

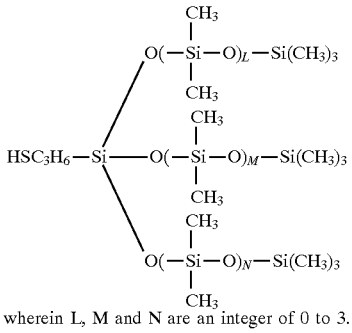

wherein L, M and N are an integer of 0 to 3.

(6)

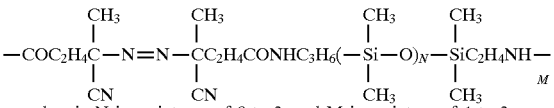

wherein N is an integer of 0 to 3, and M is an intger of 1 to 3.

Examples of a reactive silicone with a molecular weight of 5000 or more are the previously mentioned reactive silicone oil (1) in which L+M+N≧61; the reactive silicone oil (2) in which N≧64; the reactive silicone oil (3) in which N≧65; the reactive silicone oil (4) in which N≧65; the reactive silicone oil (5) in which L+M+N≧63; and the polydimethylsiloxane polymerization initiator (6) in which N≧62.

As the vinyl monomer for the preparation of the modified copolymer, any vinyl monomers that are copolymerizable with both the main backbone chain polymer and the reactive silicone can be employed.

Examples of such a vinyl monomer are vinyl monomers such as methyl acrylate, ethyl acrylate, n-butyl acrylate, i-butyl acrylate, 2-ethylhexyl acrylate, cyclohexyl acrylate, tetrahydrofurfuryl acrylate, methyl methacrylate, ethyl methacrylate, n-butyl methacrylate, i-butyl methacrylate, 2-ethylhexyl methacrylate, stearyl methacrylate, lauryl methacrylate, methyl vinyl ether, ethyl vinyl ether, n-propyl vinyl ether, n-butyl vinyl ether, i-butyl vinyl ether, styrene, α-methylstyrene, acrylonitrile, methacrylonitrile, vinyl acetate, vinyl chloride, vinylidene chloride, vinyl fluoride, vinylidene fluoride, 2-hydroxyethylacrylate, 2-hydroxyethylmethacrylate, 2-hydroxypropylacrylate, 2-hydroxypropylmethacrylate, allyl alcohol, glycidyl acrylate, glycidyl methacrylate, glycidyl allyl ether, acrylic acid, methacrylic acid, itaconic acid, crotonic acid, maleic acid, maleic anhydride, citraconic acid, acrylamide, methacrylamide, N-methylolacrylamide, N-methylolmethacrylamide, N,N-dimethylacrylamide, N,N-dimethylaminoethylmethacrylate, N,N-diethylaminoethylmethacrylate, and diacetone acrylamide; and silane coupling agents such as γ-methacryloxypropyl trimethoxysilane, γ-methacryloxy-propylmethyl dimethoxysilane, γ-methacryloxypropylmethyl diethoxysilane, vinyl trimethoxysilane, and vinyl triethoxysilane. These monomers may be used alone or in combination.

The side polymer in the modified copolymer increases the heat resistance of the heat resistant protective layer and prevents the sticking of the protective layer to the thermal head rather than improve the adhesion between the heat resistant protective layer and the substrate.

When choosing an appropriate monomer for the side chain polymer, it is important that the glass transition temperature (Tg) of the homopolymer prepared from the monomer is high. It is preferable that the glass transition temperature (Tg) of the homopolymer be 80° C. or more. In this sense, methyl methacrylate and methacrylic acid are particularly preferable for use in the present invention, since the glass transition temperature (Tg) of the homopolymer of methyl methacrylate is 105° C., and the glass transition temperature (Tg) of the homopolymer of methacrylic acid is 130° C.

It is preferable that the amount of the vinyl monomer component in the modified copolymer be in the range of about 10 to 85 wt. %.

A particularly preferable example of the side polymer is a silicone acryl copolymer.

The modified copolymer for use in the present invention is usually prepared by solution polymerization, for example, by either of the following two methods:

In method (1), a reactive silicone, a vinyl monomer and a polymerization initiator are added, with stirring, to a solution of an active-hydrogen-containing polymer with application of heat thereto.

In method (2), an unsaturated group is introduced into an active-hydrogen-containing polymer. To a solution of this unsaturated-group-introduced active-hydrogen-containing polymer, a reactive silicone, a vinyl monomer and a polymerization initiator are added, with stirring, and with application of heat thereto.

Thus, there can be produced a modified copolymer composed of (a) a main backbone chain polymer comprising the active-hydrogen-containing polymer and (b) a side chain polymer comprising a copolymer of the reactive silicone and the vinyl monomer.

Examples of a solvent for use in the above solution polymerization are aromatic hydrocarbon solvents such as toluene and xylene; ketone solvents such as acetone, methyl ethyl ketone, and methyl isobutyl ketone; ester solvents such as ethyl acetate and butyl acetate; and alcohol solvents such as ethanol and isopropanol. These solvents can be employed alone or in combination.

Examples of the polymerization initiator for use in the above solution polymerization are oil-soluble initiators such as benzoyl peroxide, lauroyl peroxide, cumene hydroperoxide, dicumyl peroxide, t-butylperoxy-isopropylcarbonate, t-butylperbenzoate, di-t-butylperoxide, azobisisobutyronitrile, and azobisvaleronitrile.

In order to conduct graft polymerization for grafting the side chain polymer on the main backbone chain polymer, there can be employed one of the previously mentioned method (1) in which a hydrogen abstraction reaction is utilized, and method (2) in which a graft active point is imparted beforehand.

In the method (1), it is preferable to employ an initiator having high hydrogen abstraction effect such as benzoyl peroxide, dicumyl peroxide, t-butylperoxyisopropylcarbonate, t-butylperbenzoate, and di-t-butylperoxide.

In the method (2), it is effective to introduce an unsaturated group into the main backbone chain polymer, for instance, by allowing methacryloyl isocyanate or isocyanate ethyl methacrylate to react with the OH group of polyvinyl acetal, or by esterifying the OH group with maleic anhydride or itaconic anhydride.

The modified copolymer for use in the present invention, which comprises (a) the main backbone chain polymer comprising an active-hydrogen-containing polymer which encompasses no cellulose compounds and (b) the side chain polymer which is a copolymer of the reactive silicone and the vinyl monomer, has the advantages over other copolymers that (1) it can be produced without carrying out a cross-linking reaction by use of a cross-linking agent, that (2) no curing process is required after coating a heat resistant protective layer formation liquid on the substrate, and that (3) the heat resistant protective layer formation liquid has no problems with respect to its pot life.

Furthermore, a heat resistant protective layer with excellent film formation properties, heat resistance and lubricating properties can be obtained use of by the above-mentioned modified copolymer which is free from cross-linking structure.

With reference to FIG. 1, a modified copolymer which is composed of (a) a main backbone chain polymer and (b) a side chain polymer composed of a copolymer of a reactive silicone and a vinyl monomer will now be explained.

In FIG. 1, reference numeral 1 indicates the main chain polymer; reference numeral 2 indicates a vinyl copolymer moiety of the side chain polymer; and reference numeral 3 indicates a silicone component moiety of the side chain polymer.

As schematically illustrated in FIG. 1, since the silicone component moiety 3 is chemically bonded to the vinyl copolymer moiety 2 of the side chain polymer, the surface of a thermal head is not smeared by the transfer of the silicone component moiety 3, and moreover the sticking of the heat resistant protective layer to the thermal head is sufficiently prevented by the lubricating properties and releasability of the silicone component moiety 3.

Furthermore, the excellent heat resistance of the vinyl copolymer moiety 2 in the side chain polymer can minimize the thermal softening of the heat resistant protective layer by the heat from the thermal head, so that the detachment of a fused material from the surface of the heat resistant protective layer can be prevented and accordingly the adhesion of such a fused material to the surface of the thermal head can also be prevented.

Furthermore, by the excellent film formation properties of the main chain polymer and also by the excellent adhesion thereof with the substrate, the heat resistant protective layer can be prevented from peeling away from the substrate, and moreover, the formation of dust by the abrasion of the heat resistant protective layer is also prevented and therefore the adhesion of such dust to the thermal head can be avoided.

The heat resistant protective layer may also be composed of a mixture of the above-mentioned modified polymer and an active-hydrogen-containing polymer, whereby the film strength of the heat resistant protective layer can be further increased.

Even if polyester, polyvinyl butyral or polyamide is added to a film made of a conventional silicone-modified acrylic resin, the film strength of the film cannot be improved because the poor compatibility of the silicone-modified acrylic resin with polyester, polyvinyl butyral or polyamide.

However, in the present invention, by use of the modified polymer and the above-mentioned active-hydrogen-containing polymer in the form of a mixture for the fabrication of the heat resistant protective layer, the film strength of the protective layer can be significantly improved because of the excellent compatibility of the modified polymer and the active-hydrogen-containing polymer.

It is preferable that the mixing ratio by weight of the modified copolymer:the active-hydrogen-containing polymer in the above-mentioned mixture be in the range of 90:10 to 50:50.

It is preferable that the active-hydrogen-containing polymer have high heat resistance and that the glass transition temperature (Tg) thereof be 100° C. or more for the improvement of the film strength of the heat resistant protective layer and for the prevention of the adhesion of a fused material from the protective layer to the thermal head.

Furthermore, the heat resistant protective layer for use in the present invention may also be composed of a mixture of the above-mentioned modified polymer and a modified silicone oil having at least one reactive functional group, whereby the sticking of the protective layer to the thermal head and the adhesion of a fused material from the protective layer to the thermal head can be avoided.

Examples of the functional group to be introduced into the modified silicone having the reactive functional group are methylstyrene, long-chain alkyl, polyether, carbinol, amine, epoxy, carboxyl, higher fatty acid, mercapto and methacryl groups.

An appropriate modified silicone oil having such a reactive functional group may be selected in view of the prevention of the adhesion of a fused material from the protective layer to the surface of the thermal head, and the heat resistance, film formation properties, film strength and lubricating properties of the protective layer.

From the viewpoint of the film formation properties and film strength, amino-modified silicone oil and epoxy-modified silicone oil are preferable for use in the present invention.

It is preferable that one equivalent of the reactive functional group of the above-mentioned modified silicone oil be 1000 g/mol or less.

It is also preferable that the amount of the modified silicone oil having a reactive functional group at a terminal thereof to be mixed with the modified copolymer be in the range of 3 to 6 parts by weight to 100 parts by weight of the modified copolymer.

It is considered that there are two representative methods of synthesizing the above-mentioned modified silicone oil. In one method, an equilibrium reaction by use of an acid or alkaline catalyst is utilized; and in the other method, an addition or condensation reaction with a silicone oil having a —Si—H moiety is utilized. Any of these synthesis methods is selected in accordance with the kind of an organic group involved therein. Generally, the former method is more productive and therefore preferable.

In the present invention, the heat resistant protective layer is formed by coating the back side of the substrate with a solution of the above-mentioned modified copolymer, a mixed solution composed of a solution of the modified copolymer and a solution of the previously mentioned active-hydrogen-containing polymer, or a mixed solution composed of a solution of the modified copolymer and a solution of the modified silicone oil having at least one reactive functional group, for instance, by use of a wire bar, and dried.

When a solution of the modified copolymer dissolved in a solvent such as methyl ethyl ketone is coated on the back side of the substrate, and the coated solution is dried to form the heat resistant protective layer, the modified copolymer takes a micro-phase-separated structure in the course of the coating of the solution of the modified copolymer.

In the micro-phase-separated structure, a block graft polymer is subjected to micro-phase-separation in the solution and forms a stable micell. When the solution is coated and dried, the block graft polymer takes a micro domain structure. This structure imparts to the heat resistant layer reciprocal properties such as releasability and adhesiveness, and heat resistance and mechanical strength.

It is preferable that the heat resistant protective layer have a thickness in the range of 0.01 to 2.00 $\mu$m, more preferably in the range of 0.04 to 0.6 $\mu$m.

As the material for the substrate for the thermal image transfer recording medium according to the present invention, there can be employed films of polycarbonate, polyarylate, polyetherimide, polysulfone, polyphenyl ether, polyamide imide, polyimide, polyethylene naphthalate, polyphenylsulfide, polyether ether ketone, and fluoroplastics; and films of polyethylene terephthalate, polybutylene terphthalate, polybutylene naphthalate, polyethylene, polypropylene, polystyrene, polyvinyl chloride, polyvinylidene chloride, and nylon.

As the substrate for the thermal image transfer recording medium of the present invention, a biaxially oriented film is prefervable.

Furthermore, it is preferable that the thickness of the substrate be 6 $\mu$m or less in view of the thermal recording sensitivity of the thermal image transfer recording medium of the present invention.

As the thermal image transfer ink layer for the thermal image transfer recording medium of the present invention, conventional ink layers can be employed as they are, and there is no particular restriction to the thermal image transfer ink layer.

More specifically, the thermal image transfer ink layer for the thermal image transfer recording medium of the present invention may be composed of a coloring agent, a wax component, a resin component, a lubricating agent, and an additive such as a surfactant.

Specific examples of a coloring agent for use in the thermal image transfer ink layer include pigments and dyes such as carbon black, red oxide, Lake Red C, Fast Sky Blue, Benzidine Yellow, Phthalocyanine Green, Phthalocyanine Blue, direct dyes, oil dyes, and basic dyes.

Specific examples of a was component for use in the thermal image transfer ink layer include natural waxes such as carnauba wax, auricury wax, canderilla wax, Japan wax, cane wax, montan wax, ozokerite, microcrystalline wax, ceresine wax, and paraffin wax; synthetic waxes such as Fischer Tropsch wax, low-molecular-weight polyethylene, oxidized wax, and hydrogenated wax.

Specific examples of a resin component for use in the thermal image transfer ink layer include vinyl resins such as polyacrylic acid, polyacrylate, polymethacrylic acid, polymethacrylate, polyacrylamide, polystyrene, polyvinyl acetate, polyvinyl alcohol, polyvinyl butyral, polyvinyl pyrrolidone, polyvinyl chloride, and polyvinylidene chloride; cellulose resins such as ethyl cellulose, hydroxyethyl cellulose, ethylhydroxy cellulose, hydroxypropyl cellulose, methyl cellulose, and cellulose acetate; polyester resin; polyacetal resin; epoxy resin; terpene resin; rosin resin; fluoroplastics; and silicone resin.

Specific examples of an additive for use in the thermal image transfer layer include fatty acid, metallic salts of fatty acid, esters of fatty acid, fatty acid amides, inorganic salts, nonionic surfactants, cationic surfactants, anionic surfactants, and ampholytic surfactants.

The thermal image transfer ink layer can be formed by any of conventionally known methods and there is no particular restriction thereto.

Other features of this invention will become apparent in the course of the following description of exemplary embodiments, which are given for illustration of the invention and are not intended to be limiting thereof.

The production of the modified copolymer for use in the heat resistant protective layer now be explained.

Production Example 1

In a 500 ml flask equipped with a stirrer, a thermometer, a condenser and a nitrogen gas introducing tube, 10 parts by weight of a commercially available polyvinyl acetal (Trademark "S-Lec KS-5" made by Sekisui Chemical Co., Ltd.) and 50 parts by weight of methyl ethyl ketone were placed.

The polyvinyl acetal was dissolved in the methyl ethyl ketone by heating the mixture to 70° C., and the mixture was then cooled to 20° C.

To this mixture, 1 part by weight of methacryloyl isocyanate was added to allow the mixture to react with the polyvinyl acetal for 30 minutes, whereby an unsaturated-double-bond-containing polyvinyl acetal solution was obtained, with the introduction of an unsaturated double bond into the polyvinyl acetal.

80 parts by weight of toluene and 80 parts by weight of ethanol were added to the above obtained unsaturated-double-bond-containing polyvinyl acetal solution, and this mixture was heated to 70° C.

To the above mixture was added dropwise a mixture composed of 5 parts by weight of a commercially available reaction silicone with a molecular weight of 10,000 (Trademark "FM-0725" made by Chisso Corporation), 15 parts by weight of 3-methacryloxypropyltris (trimethylsiloxy)silane with a molecular weight of 422.8, 60 parts by weight of methyl methacrylate, 10 parts by weight of methacrylic acid, and 1 part by weight of azobisisobutyronitrile, from a dropping funnel over a period of 2 hours.

The temperature of the above reaction mixture was maintained at the same temperature as mentioned above for 4 hours, whereby a resin liquid with a solid component content of 32 wt. %, which is hereinafter referred to as resin liquid A, was obtained.

Production Example 2

The procedure for producing the resin liquid A in Production Example 1 was repeated except that 5 parts by weight of the reactive silicone "FM-0725" employed in Production Example 1 were replaced by 5 parts by weight of a commercially available reactive silicone with a number average molecular weight of 30,000 (Trademark "AK-30" made by Toagosei Co., Ltd.), and 15 parts by weight of the 3-methacrylsiloxypropyltris(trimethylsiloxy)silane employed in Production Example 1 were replaced by 15 parts by weight of 1-(3-methacryloxy-propyl)-1,1,3,3,3-pentamethyldisiloxyane with a molecular weight of 274.5, whereby a resin liquid with a solid component content of 33 wt. %, which is hereinafter referred to as resin liquid B, was obtained.

Production Example 3

In a 500 ml flask equipped with a stirrer, a thermometer, a condenser and a nitrogen gas introducing tube, 20 parts by weight of a commercially available polyvinyl butyral (Trademark "Denka Butyral #6000-C" made by Denki Kagaku Kogyo Kabushiki Kaisha), 80 parts by weight of toluene and 80 parts by weight of butanol were placed, and this reaction mixture was heated to 110° C., with stirring.

To the above mixture was added dropwise a mixture composed of 10 parts by weight of a commercially available reactive silicone with a molecular weight of 5,000 (Trademark "FM-0721" made by Chisso Corporation), 15 parts by weight of 3-methacryloxypropyl-tris (trimethylsiloxy)silane with a molecular weight of 422.8, 45 parts by weight of methyl methacrylate, 10 parts by weight of methacrylic acid, and 1 part by weight of t-butylperoxyisopropylcarbonate, from a dropping funnel over a period of 2 hours.

The temperature of the above reaction mixture was then raised to 115° C. to complete the polymerization, whereby a resin liquid, which is hereinafter referred to as resin liquid C, was obtained.

Production Example 4

A mixture of 100 parts by weight of the resin liquid A produced in Production Example 1, 30 parts by weight of a commercially available polyvinyl acetal (Trademark "S-Lec KS-5" made by Sekisui Chemical Co., Ltd.), 35 parts by weight of toluene and 35 parts by weight of ethanol was stirred for 1 hour, whereby a resin liquid with a solid component content of 31 wt. %, which is hereinafter referred to as resin liquid D, was obtained.

Production Example 5

In a 500 ml flask equipped with a stirrer, a thermometer, a condenser and a nitrogen gas introducing tube, 10 parts by weight of a commercially available N-methoxymethylated nylon (Trademark "TORESIN F-30" made by Teikoku Chemical Industries Co., Ltd.), 60 parts by weight of methyl methacrylate, 30 parts by weight of a commercially available silicone macromonomer with a molecular weight of about 5,000 (Trademark "AK-5" made by Toagosei Co., Ltd.), 0.5 parts by weight of a commercially available t-butylperoxyisopropyl carbonate (Trademark "BIC-75" made by Kayaku AKZO Corporation), 10 parts by weight of toluene, 20 parts by weight of methyl alcohol, and 10 parts by weight of cyclohexanone were placed, and this reaction mixture was allowed to react at 80° C. for 4 hours.

To the above reaction mixture was added a solution of 0.05 parts by weight of the t-butylperoxyisopropyl carbonate (Trademark "BIC-75" made by Kayaku AKZO Corporation) in 20 parts by weight of toluene, and this reaction mixture was further allowed to react at 80° C. for 4 hours, whereby a milky white resin liquid, which is hereinafter referred to as resin liquid E, was obtained.

Production Example 6

In a 500 ml flask equipped with a stirrer, a thermometer, a condenser and a nitrogen gas introducing tube, 10 parts by weight of a commercially available polyvinyl acetal (Trademark "S-Lec KS-5" made by Sekisui Chemical Co., Ltd.) and 200 parts by weight of methyl ethyl ketone were placed.

The polyvinyl acetal was dissolved in the methyl ethyl ketone by heating the mixture to 70° C., and the mixture was then cooled to 20° C.

To this mixture, 1 part by weight of methacryloyl isocyanate was added to allow the mixture to react with the polyvinyl acetal for 30 minutes, whereby an unsaturated-double-bond-containing polyvinyl acetal solution was obtained, with the introduction of an unsaturated double bond into the polyvinyl acetal.

80 parts by weight of toluene and 80 parts by weight of ethanol were added to the above obtained unsaturated-double-bond-containing polyvinyl acetal solution, and this mixture was heated to 70° C.

To the above mixture was added dropwise a mixture composed of 20 parts by weight of a commercially available reactive silicone with a molecular weight of 10,000 (Trademark "FM-0725" made by Chisso Corporation), 60 parts by weight of methyl methacrylate, 10 parts by weight of methacrylic acid, and 1 part by weight of azobisisobutyronitrile, from a dropping funnel over a period of 2 hours.

The temperature of the above reaction mixture was maintained at the same temperature as mentioned above for 4 hours, whereby a resin liquid with a solid component content of 33 wt. %, which is hereinafter referred to as resin liquid F, was obtained.

Production Example 7

The procedure for producing the resin liquid F in Production Example 6 was repeated except that the reactive silicone "FM-0725" employed in Production Example 6 was replaced by 3-methacryloxypropyl-tris(trimethylsiloxy) silane, whereby a resin liquid with a solid component content of 33 wt. %, which is hereinafter referred to as resin liquid G, was obtained.

Comparative Example 1

In a 500 ml flask equipped with a stirrer, a thermometer, a condenser and a nitrogen-gas introducing tube, 200 parts by weight of methyl ethyl ketone were placed and heated to 70° C.

To the above methyl ethyl ketone was added dropwise a mixture composed of 35 parts by weight of a commercially available reactive silicone with a number average molecular weight of 30,000 (Trademark "AK-30" made by Toagosei Co., Ltd.), 55 parts by weight of methyl methacrylate, 10 parts by weight of methacrylic acid, and 1 part by weight of azobisisobutyronitrile from a dropping funnel over a period of 2 hours, whereby a resin liquid with a solid component content of 34 wt. %, which is hereinafter referred to as resin liquid H, was obtained.

Example 1

The resin liquid A produced in Production Example 1 was diluted with a mixed solvent of methyl ethyl ketone and cyclohexanone (9:1) so that a heat resistant protective layer formation liquid with a solid component content of 4 wt. % was prepared.

The thus prepared heat resistant protective layer formation liquid was coated on the back side of a polyethylene terephthalate (PET) film with a thickness of about 4.5 $\mu$m by a wire bar and dried at 100° C. for 5 seconds, whereby a heat resistant protective layer with a thickness of about 0.3 $\mu$m was formed on the back side of the PET film.

A thermal image transfer ink layer formation liquid was prepared by dispersing a mixture of the following components with the following formulation:

| | Parts by Weight |
|---|---|
| Carnauba wax | 6 |
| Paraffin wax | 8 |
| Carbon black | 4 |
| Toluene | 82 |

The thus prepared thermal image transfer ink layer formation liquid was coated on the front side of the PET film, opposite to the heat resistant protective layer with respect to the PET film, and dried, whereby a thermal image transfer ink layer with a deposition amount of about 2.8 g/m$^2$ was provided on the front side of the PET film.

Thus, a thermal image transfer recording medium No. 1 of the present invention was fabricated.

Example 2

The resin liquid B produced in Production Example 2 was diluted with a mixed solvent of methyl ethyl ketone and cyclohexanone (9:1) so that a heat resistant protective layer formation liquid with a solid component content of 4 wt. % was prepared.

The thus prepared heat resistant protective layer formation liquid was coated on the back side of a PET film with a thickness of about 4.5 $\mu$m by a wire bar and dried at 100° C. for 5 seconds, whereby a heat resistant protective layer with a thickness of about 0.3 $\mu$m was formed on the back side of the PET film.

The same thermal image transfer ink layer as formed in Example 1 was provided in the same manner as in Example 1 on the front side of the PET film, whereby a thermal image transfer recording medium No. 2 of the present invention was fabricated.

Example 3

The resin liquid C produced in Production Example 3 was diluted with a mixed solvent of methyl ethyl ketone and cyclohexanone (9:1) so that a heat resistant protective layer formation liquid with a solid component content of a 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.5 μm was formed on the back side of the PET film.

The same thermal image transfer ink layer as formed in Example 1 was provided in the same manner as in Example 1 on the front side of the PET film, whereby a thermal image transfer recording medium No. 3 of the present invention was fabricated.

Example 4

The resin liquid D produced in Production Example 4 was diluted with a mixed solvent of methyl ethyl ketone and cyclohexanone (9:1) so that a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 4 of the present invention was fabricated.

Example 5

The resin liquid E produced in Production Example 5 was diluted with a mixed solvent of methyl ethyl ketone, cyclohexanone and isopropyl alcohol (5:2:3) so that a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 5 of the present invention was fabricated.

Example 6

The resin liquid F produced in Production Example 6 was diluted with a mixed solvent of methyl ethyl ketone and cyclohexanone (9:1) so that a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 6 of the present invention was fabricated.

Example 7

The resin liquid G produced in Production Example 7 was diluted with a mixed solvent of methyl ethyl ketone and cyclohexanone (9:1) so that a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 7 of the present invention was fabricated.

Example 8

The resin liquid B produced in Production Example 2 was diluted with a mixed solvent of methyl ethyl ketone and cyclohexanone (9:1) so that a diluted resin liquid with a solid component content of 4 wt. % was prepared.

To this diluted resin liquid was added a 4% solution of a carboxy-modified silicone oil with a functional group equivalent of 2330 mg/mol in a mixed solvent of methyl ethyl ketone and cyclohexanone (9:1) in such a ratio that 95 parts by weight of the diluted resin liquid were mixed with 5 parts by weight of the 4% solution of the carboxy-modified silicone oil in the mixed solvent of methyl ethyl ketone and cyclohexanone, whereby a heat resistant protective layer formation liquid was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 8 of the present invention was fabricated.

Example 9

The resin liquid B produced in Production Example 2 was diluted with a mixed solvent of methyl ethyl ketone and cyclohexanone (9:1) so that a diluted resin liquid with a solid component content of 4 wt. % was prepared.

To this diluted resin liquid was added a 4% solution of an amino-modified silicone oil with a functional group equivalent of 1500 mg/mol in a mixed solvent of methyl ethyl ketone and cyclohexanone (9:1) in such a ratio that 95 parts by weight of the diluted resin liquid were mixed with 5 parts by weight of the 4% solution of the amino-modified silicone oil in the mixed solvent of methyl ethyl ketone and cyclohexanone, whereby a heat resistant protective layer formation liquid was prepared.

The thus prepared heat resistant protective layer formation liquid was coated on the back side of a PET film with a thickness of about 4.5 μm by a wire bar and dried at 100°

C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 9 of the present invention was fabricated.

Example 10

The resin liquid B produced in Production Example 2 was diluted with a mixed solvent of methyl ethyl ketone and cyclohexanone (9:1) so that a diluted resin liquid with a solid component content of 4 wt. % was prepared.

To this diluted resin liquid was added a 4% solution of an amino-modified silicone oil with a functional group equivalent of 840 mg/mol in a mixed solvent of methyl ethyl ketone and cyclohexanone (9:1) in such a ratio that 95 parts by weight of the diluted resin liquid were mixed with 5 parts by weight of the 4% solution of the amino-modified silicone oil in the mixed solvent of methyl ethyl ketone and cyclohexanone, whereby a heat resistant protective layer formation liquid was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a thermal image transfer recording medium No. 10 of the present invention was fabricated.

Comparative Example 1

The resin liquid H produced in Comparative Production Example 1 was diluted with methyl ethyl ketone, whereby a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a comparative thermal image transfer recording medium No. 1 was fabricated.

Comparative Example 2

A 4% solution of a mixture of polyvinyl acetal and an alcohol-modified silicone oil (90:10) in a mixed solvent of methyl ethyl ketone and toluene (5:5) was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a comparative thermal image transfer recording medium No. 2 was fabricated.

Comparative Example 3

The resin liquid H produced in Comparative Production Example 1 and a 5% methyl ethyl ketone solution of a commercially available polyvinyl acetal (Trademark "S-Lec KS-5" made by Sekisui Chemical Co., Ltd.) were respectively diluted with methyl ethyl ketone in such a manner that the ratio of the solid component content of the diluted resin liquid to the solid component content of the methyl ethyl ketone solution of the polyvinyl acetal was 80:20, and that the diluted resin liquid and the methyl ethyl ketone solution of the polyvinyl acetal were mixed in such a manner that total content of the solid components in the mixture of the diluted resin liquid and the methyl ethyl ketone solution of the polyvinyl acetal was 4 wt. %, whereby a heat resistant protective layer formation liquid with a solid component content of 4 wt. % was prepared.

The thus prepared heat resistant protective layer formation liquid was coated on the back side of a PET film with a thickness of about 4.5 μm by a wire bar and dried at 100° C. for 5 seconds, whereby a heat resistant protective layer with a thickness of about 0.3 μm was formed on the back side of the PET film.

The same thermal image transfer ink layer as formed in Example 1 was provided in the same manner as in Example 1 on the front side of the PET film, whereby a comparative thermal image transfer recording medium No. 3 was fabricated.

With respect to each of the above fabricated thermal image transfer recording media Nos. 1 to 10 of the present invention and the comparative thermal image transfer recording media Nos. 1 to 3, the film strength of the heat resistant protective layer, the contact angle with pure water and the dynamic coefficient of friction of the surface of the heat resistant protective layer were measured by the previously mentioned methods. The results are shown in TABLE 2.

Furthermore, each of the above fabricated thermal image transfer recording media Nos. 1 to 10 of the present invention and the comparative thermal image transfer recording media Nos. 1 to 3 was subjected to a thermal printing test to evaluate the sticking prevention performance, and the smearing of a thermal head with a fused material from each heat resistant protective layer and/or with dust formed by the physical detachment or peeling of a portion of each heat resistant protective layer during thermal printing operation.

The sticking prevention performance and the smearing of the thermal head were respectively evaluated as follows:

(1) Sticking Preventing Performance

Thermal image transfer printing was conducted under the following conditions and the occurrence of the sticking was confirmed by the formation of wrinkles in the tested thermal image transfer recording medium or by the generation of sticking noise during the thermal printing operation:

[Thermal Printing Conditions]

Thermal head: Thin-film line thermal head (density: 8 lines/mm) (made by Kyocera Corporation)

Printing energy: 25 mJ/mm$^2$

Printing speed: 50 mm/sec

Platen pressure: 350 gf/cm

Image receiving sheet: White PET label (made by Lintec Corporation)

Printing pattern: CODE 39 transverse bar code (Narrow 2: Wide 5 dots) Code width: 30 mm, Code length: about 40 mm (2) Smearing of Thermal Head Under the above mentioned thermal printing conditions, thermal printing was continuously performed over a length of 100 m by use of CODE 39 vertical bar code (Narrow 2: Wide 6 dots) as a printing pattern to see if there was any deposition of a fused material on the thermal head and any deposition of dust formed by the physical detachment or peeling of a portion of each heat resistant protective layer on the thermal head were during thermal printing operation.

The results of the above evaluation tests are also shown in the following TABLE 2:

TABLE 2

| | Film Strength (mN) | Contact Angle with Pure Water (°) | Dynamic Coefficient of Friction | Sticking | Smearing of Thermal Head: Deposition of Fused Material | Smearing of Thermal Head: Deposition of Dust |
|---|---|---|---|---|---|---|
| Ex. 1 | 15 | 98 | 0.04 | ○ | ○ | Δ |
| Ex. 2 | 14 | 103 | 0.03 | ○ | ○ | Δ |
| Ex. 3 | 10 | 102 | 0.05 | ○ | Δ | ○ |
| Ex. 4 | 24 | 101 | 0.04 | ○ | ○ | ○ |
| Ex. 5 | 18 | 98 | 0.05 | ○ | Δ | ○ |
| Ex. 6 | 16 | 102 | 0.06 | Δ | ○ | ○ |
| Ex. 7 | 20 | 105 | 0.07 | Δ | ○ | ○ |
| Ex. 8 | 14 | 108 | 0.05 | ○ | ○ | Δ |
| Ex. 9 | 14 | 106 | 0.04 | ○ | ○ | Δ |
| Ex. 10 | 14 | 115 | 0.03 | ○ | ○ | ○ |
| Comp. Ex. 1 | 2 | 102 | 0.04 | ○ | x | xx |
| Comp. Ex. 2 | 20 | 79 | 0.10 | x | x | x |
| Comp. Ex. 3 | 0.5 | 115 | 0.06 | x | x | xx |

Note:
○: No sticking or smearing
Δ: Slight sticking or smearing
x: Conspicuous sticking or smearing
xx: Considerable smearing The results shown in TABLE 2 indicate that the thermal image transfer recording media of the present invention were sufficiently capable of preventing the occurrence of the sticking and also capable of preventing not only the deposition of a fused material from the heat resistant protective layer on the thermal head, but also the deposition of the dust formed by the wearing of the heat resistant protective layer on the thermal head, whereby thermal image transfer recording with excellent printing quality was performed.

Furthermore, the thermal image transfer recording media of the present invention were excellent in the running performance during the thermal printing operation.

Japanese Patent Applications Nos. 6-242345 filed Sep. 9, 1994 and 6-262176 filed Oct. 26, 1994 are hereby incorporated by reference.

What is claimed is:

1. A thermal image transfer recording medium comprising:

a substrate, a thermal image transfer ink layer provided on said substrate, and a heat resistant protective layer which is provided on the back side of said substrate, opposite to said thermal transfer ink layer with respect to said substrate, with which a thermal head comes into contact, said heat-resistant protective layer comprising a modified copolymer which comprises (a) a main backbone chain polymer comprising an active-hydrogen-containing polymer which encompasses no cellulose compounds and (b) a side chain polymer which is a copolymer of a reactive silicone and a vinyl monomer.

2. The thermal image transfer recording medium as claimed in claim 1, wherein said active-hydrogen-containing polymer is selected from the group consisting of polyvinyl acetoacetal and polyvinyl butyral.

3. The thermal image transfer recording medium as claimed in claim 1, wherein said side chain polymer is a silicone-acrylic copolymer.

4. The thermal image transfer recording medium as claimed in claim 1, wherein the amount of said reactive silicone is in the range of 5 to 60 wt. % of the entire weight of said modified copolymer.

5. The thermal image transfer recording medium as claimed in claim 1, wherein said reactive silicone in said side chain polymer comprises a first reactive silicone with a molecular weight of less than 500 and a second reactive silicone with a molecular weight of 5000 or more.

6. Thermal image transfer recording medium as claimed in claim 1, wherein said heat resistant protective layer further comprises and active-hydrogen-containing polymer which encompasses no cellulose compounds, so as to form a mixture in combination with said modified copolymer.

7. The thermal image transfer recording medium as claimed in claim 6, wherein said active-hydrogen-containing polymer has a glass transition temperature of 100° C. or more.

8. Thermal image transfer recording medium as claimed in claim 1, wherein said heat resistant protective layer further comprises a modified silicone oil having at least one reactive functional group so as to form a mixture in combination with said modified copolymer.

9. The image transfer recording medium as claimed in claim 8, wherein one equivalent of said reactive functional group of said modified silicone oil is 1000 g/mol or less.

10. The image transfer recording medium as claimed in claim 8, wherein said reactive functional group of said modified silicone oil is selected from the group consisting of amino groups and epoxy groups.

* * * * *

UNITED STATES PATENT AND TRADEMARK OFFICE

CERTIFICATE OF CORRECTION

PATENT NO. : 5,773,153

DATED : June 30, 1998

INVENTOR(S): Shiokawa et al

It is certified that an error appears in the above-identified patent and that said Letters Patent is hereby corrected as shown below:

Column 1, line 40, "referred to a sticking" should read --referred to as a sticking--.

Column 5, line 57, "more in com-" should read --more be used in com- --.

Column 6, line 64, "intger" should read --integer--.

Column 10, line 56, "prefervable" should read --preferable--.

Column 13, line 63, "Comparative Example 1" should read --Comparative Production Example 1--.

Signed and Sealed this

Thirtieth Day of November, 1999

*Attest:*

*Attesting Officer*

Q. TODD DICKINSON

*Acting Commissioner of Patents and Trademarks*